US005272991A

United States Patent [19]

Carrigan, Jr.

[11] Patent Number: 5,272,991

[45] Date of Patent: Dec. 28, 1993

[54] SHELVING APPARATUS

[75] Inventor: Richard M. Carrigan, Jr., Evanston, Ill.

[73] Assignee: United Wire Craft, Inc., Chicago, Ill.

[21] Appl. No.: 806,595

[22] Filed: Dec. 12, 1991

[51] Int. Cl.[5] ..... A47B 9/00; A47B 57/00

[52] U.S. Cl. ..... 108/108; 211/188; 211/193

[58] Field of Search ..... 108/108, 102, 106, 110, 108/111, 152; 248/222.1, 225.1; 211/188, 193, 194, 208

[56] References Cited

U.S. PATENT DOCUMENTS

| | | | |
|---|---|---|---|
| 136,722 | 11/1943 | Waterman . | |
| 2,529,649 | 11/1950 | Coplen | 211/148 |
| 2,941,772 | 6/1960 | Thayer et al. | 248/120 |
| 3,067,882 | 12/1962 | Ribbens et al. | 108/108 |
| 3,146,732 | 9/1964 | Tozier | 108/152 |
| 3,252,614 | 5/1966 | Evans | 108/152 |
| 3,381,636 | 5/1968 | Saiberlich | 108/108 |
| 3,420,480 | 1/1969 | Matson | 248/222.1 |
| 3,508,666 | 4/1970 | Schwengel | 211/208 |
| 3,669,035 | 6/1972 | Grossman | 108/152 |
| 3,705,654 | 12/1972 | Barrineau, III | 211/176 |
| 3,915,097 | 10/1975 | Young, Jr. | 108/6 |
| 4,231,301 | 11/1980 | Barrineau, III | 108/146 |
| 4,292,902 | 10/1981 | Barrineau | 108/146 |
| 4,391,378 | 7/1983 | Secon | 211/187 |
| 4,716,841 | 1/1988 | Suttles | 211/193 |
| 4,778,066 | 10/1988 | Stjernberg | 211/186 |

FOREIGN PATENT DOCUMENTS

| | | | |
|---|---|---|---|
| 209327 | 7/1957 | Australia . | |
| 74107 | 4/1952 | Denmark . | |
| 1333926 | 6/1962 | France | 108/106 |
| 1325708 | 8/1973 | United Kingdom | 248/222.1 |

OTHER PUBLICATIONS

Excerpt of assembly instructions from American Tobacco Company entitled, "Shelf Taker Holder—Folding Instructions".

*Primary Examiner*—James R. Brittain
*Assistant Examiner*—Janet M. Long
*Attorney, Agent, or Firm*—Fitch, Even, Tabin & Flannery

[57] ABSTRACT

Shelving apparatus includes a base member with upright supports. A frame member is telescopically inserted on the base supports, and includes horizontal slide supports for receiving slide mounting members of a shelf. Pairs of shelves may be mounted on a single slide support to provide flexibility in configuring the shelving apparatus.

9 Claims, 2 Drawing Sheets 50
52
54
56
58
66
60
10
110
38
44
46
48
5
72
104
84
76
6
34
30
32
4
16
12
14
a
20
22
24
40
64
a
b
c
d
e
f
g
h
i
j
k
l
m
n

SHELVING APPARATUS

BACKGROUND OF THE INVENTION

1. Field of the Invention

The present invention pertains to shelving apparatus, and in particular, to shelving apparatus which can be assembled in a variety of different configurations.

2. Description of the Related Art

The present invention is directed to shelving apparatus which is manufactured at a factory location and shipped to an end user. In order to reduce shipping costs and to qualify for conventional shipping services, shelving apparatus is frequently fabricated in a kit form for assembly by an end user. As purchasers of unassembled shelving units are aware, a substantial labor investment is necessary for assembly of more complicated shelving arrangements having separate upright standards and multiple shelves, for example. Purchasers of shelving apparatus appreciate the cost savings associated with unassembled shelving units and the labor investment required for assembly has, in general, not been objectionable.

However, other considerations apply when shelving apparatus is provided in a commercial context to display a supplier's product. For example, suppliers of retail merchandise often have extensive distribution networks comprising multiple retail store locations. In an effort to compete for floor space at a store location, suppliers of retail merchandise may offer shelving units to assist a store in displaying the merchandise. In general, it has been found desirable to provide a store location with an unassembled shelf kit and to rely on store personnel for assembly and installation of the shelving apparatus at a place and time convenient for the store personnel, as opposed to having the supplier of the retail merchandise assemble the shelving units at a time which might not be convenient for the store personnel. Accordingly, the shelving apparatus for these applications must be quickly and easily assembled without burdening store personnel, and without requiring special tools or expertise.

In order to provide cost savings for a merchandise supplier, the shelving apparatus should be flexible, being readily assembled or reassembled in a variety of different configurations which can be adapted as display requirements change. For example, it is desirable that a shelving apparatus be reconfigured to hold varying amounts of retail merchandise. Shelving apparatus located at an interior of a store or along a store wall can receive support from the store wall or a support column located in the interior of a store location. At times, only very limited portions of the wall mounted shelving apparatus is visible, especially when the shelving apparatus is filled with product. However, shelving apparatus is also installed at point-of-purchase locations, such as a checkout counter or a location adjacent a cash register checkout facility. Counter displays of this type are subject to closer scrutiny by a consumer and must be attractive so as to present a pleasing appearance to the consumer. Consumers are much closer to the shelving apparatus which is positioned on a checkout counter, and consumers may find extended opportunities for examination of the display apparatus while awaiting service at the checkout facility. For these and other reasons, counter displays should be tamper-proof as well as attractive, even upon close examination.

SUMMARY OF INVENTION

It is an object according to the present invention to provide shelving apparatus which can be assembled in a number of different configurations.

Another object according to the present invention is to provide shelving apparatus of the above type which can be installed on a counter adjacent a checkout or other facility.

Yet another object of the present invention is to provide shelving apparatus of the above-described type which is attractive, yet tamper-resistant, while being readily reconfigurable by store personnel.

Yet another object according to the present invention is to provide shelving apparatus of the above-described type which is quickly and easily assembled by store personnel without requiring special tools or expertise.

These and other objects according to the present invention, which will become apparent from setting the appended description and claims, are provided in a shelving apparatus, comprising:

a base member including a pair of upright base supports;

an upright frame member including at least two spaced apart, generally upright frame supports telescopically mated with said base supports and at least two spaced apart generally horizontal slide supports between said frame supports having a preselected length and a cross-section throughout said length;

a plurality of shelves cantilevered from said slide supports, said shelves including a rear portion with a slide mounting member having a length and a preselected cross-section throughout said length complementing the cross-section of said slide supports and said slide mounting member extending in a lengthwise direction between said frame supports;

said slide supports and said slide mounting members telescopically engaged with one another; and at least one fastener means extending through each telescopically engaged slide support and slide mounting member to prevent disengagement thereof.

DETAILED DESCRIPTION OF THE PREFERRED EMBODIMENT

Figures 1, 3, 4, 5, 11:
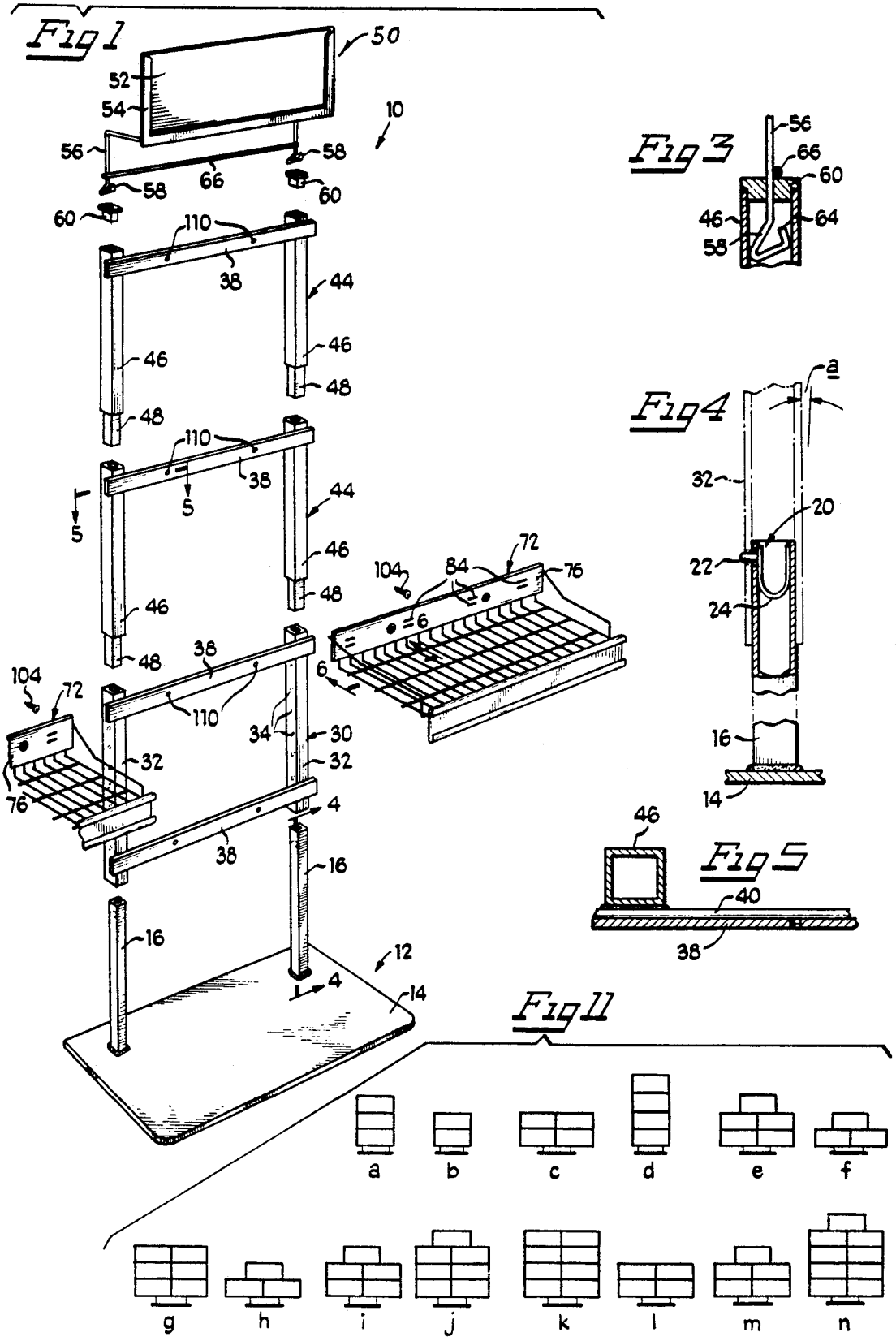
FIG. 1 is an exploded, perspective view of shelving apparatus according to principles of the present invention.
FIG. 3 is a fragmentary, cross-sectional, elevational view taken along the line 3—3 of FIG. 2.
FIG. 4 is a fragmentary, cross-sectional, elevational view taken along the line 4—4 of FIG. 1.
FIG. 5 is a fragmentary plan view taken along the line 5—5 of FIG. 1.
FIG. 11 is a schematic illustration showing various configurations of the shelving apparatus, shown in elevational view.
Figure 2:
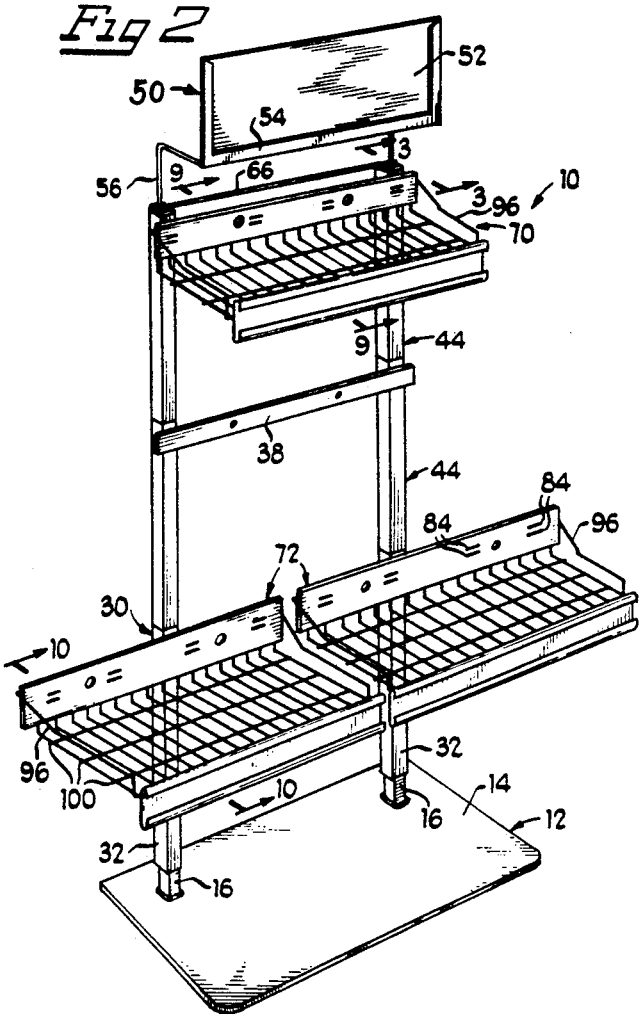
FIG. 2 is a perspective view thereof shown assembled.

Referring now to the drawings, and initially to FIG. 1, shelving apparatus generally indicated at 10 is shown in an exploded view. As will be seen herein, the shelving apparatus can be quickly and easily assembled without requiring special tools or expertise. FIG. 2 shows an assembly of the shelving apparatus in one particular configuration, corresponding to the schematic view of FIG. 11(*h*), where two rows of trays are provided, the upper row having a single tray, and the lower row having two trays side-by-side.

Referring again to FIG. 1, apparatus 10 comprises a base member generally indicated at 12, including a plate 14 and a pair of generally-upright base supports 16. Preferably, the base supports 16 are welded at their lower ends to plate 14 so as to be raked at a slight backward angle a, as illustrated in FIG. 4. Other conventional means of attaching base supports 16 to plate 14 can be used, and the base supports can be oriented generally perpendicular to plate 14, if desired.

As indicated in FIG. 4, the base supports 16 are preferably formed of hollow, generally rectangular, tubular members. This construction allows the insertion of a push-button assembly 20 within the tubular body. Push-button assembly 20 includes a push-button 22 and a spring 24 which urges push-button 22 in an outward direction.

Figure 9:
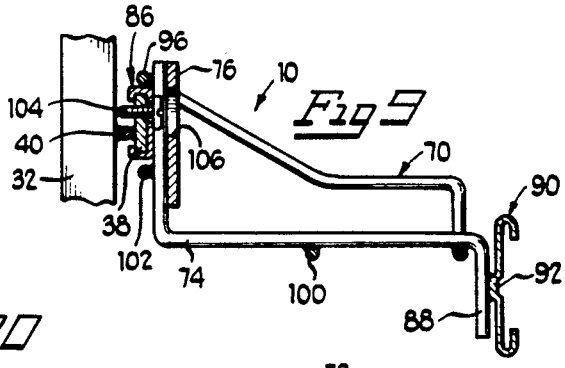
FIG. 9 is a cross-sectional, elevational view taken along the line 9—9 of FIG. 2.
Figure 10:
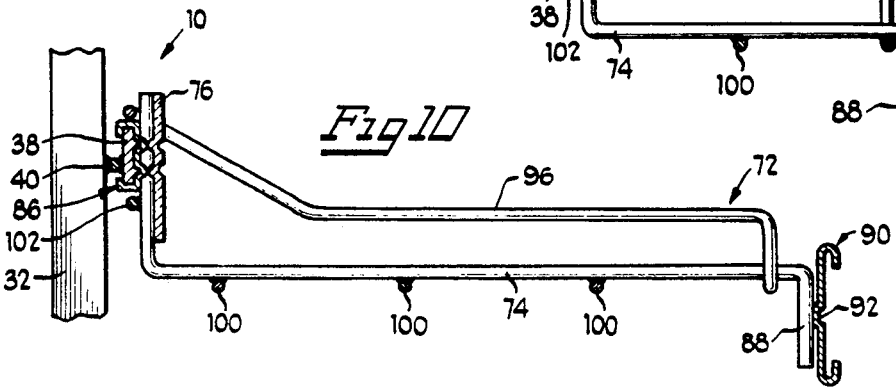
FIG. 10 is a fragmentary, cross-sectional view taken along the line 10—10 of FIG. 2.

A frame member generally indicated at 30 includes frame supports 32 preferably formed of hollow, rectangular tubes dimensioned for telescopic reception over the free ends of base supports 16. The frame supports 32, include a series of apertures 34 for receiving push-buttons 22, thereby providing adjustment for the amount of telescopic insertion of the base supports within the frame supports. A pair of slide supports or crossbars 38 extend in a generally horizontal direction between the frame supports 32. As can be seen in FIGS. 9 and 10, for example, crossbar 38 has a generally flat bar configuration, with rectangular, elongated, cross-sectional shape.

The crossbars 38 are secured to frame supports 32 by welding so as to align the frame supports in a common plane. Preferably, the crossbars 38 are spaced from the frame supports by a mounting wire 40, with the crossbars 38 welded to their rear major face to mounting wire 40, which in turn is welded to the forward face of frame supports 32. As shown in FIGS. 9 and 10, the crossbars 38 are backwardly raked with respect to the common plane of the frame supports 32. Accordingly, the longitudinal centerline of the crossbar cross-section is inclined with respect to the centerlines of frame supports 32. As will be seen herein, this preferred inclination of crossbars 38 with respect to frame supports 32, and the backward rake of frame supports 32 with respect to plate 14, elevates the forward edges of the shelves. This construction insures that product stored on the shelves will slide or roll to the back of the shelves, which are conveniently formed with a tray-like configuration.

Referring again to FIG. 1, apparatus 10 is illustrated with a pair of extension members generally indicated at 44. The extension members are optional and may be omitted, if desired. Each extension member 44 includes a pair of extension supports 46 and at least one crossbar slide support 38 therebetween. The extension supports 46 have lower ends 48 which are dimensioned for telescopic insertion within the frame supports 32. Preferably, the telescopic interfitting aligns the various supports of the base, frame and extension members along coplanar, common centerlines. The crossbars 38 are secured to extension supports 46 in the manner illustrated in FIGS. 9 and 10, using mounting wires 40 so as to space the upper and lower edges of the crossbars 38 from extension supports 46.

A header member generally indicated at 50 includes a holder 52 with channels 54 forming a pocket for receiving a placard. The holder 52 is mounted to supports 46 by a wire body 56 which includes generally hook-shaped feet which are telescopically insertable within supports 46, in a manner illustrated in FIG. 3. Preferably, plastic end caps 60 are employed to seal the upper, open ends of extension supports 46. The plastic cap 60 is turned upside down and inserted over the free end 64 of the hook-shaped portion 58, to assume the position illustrated in FIG. 3 where the cap rests against a cross-wire 66.

A complete assembly is illustrated in FIG. 2, including three shelf members, a smaller shelf 70, and two larger shelf members 72. In the preferred embodiment, the shelf members 70, 72 are substantially identical except for the depth of the shelf. Preferably, the shelf members all have approximately the same width, corresponding to the outside distance between the various support members, which is preferably held constant between the various base frame and extension members.

Figure 6:
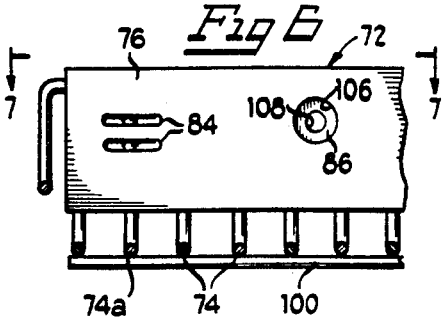
FIG. 6 is a fragmentary, cross-sectional, elevational view taken along the line 6—6 of FIG. 1.
Figure 7:
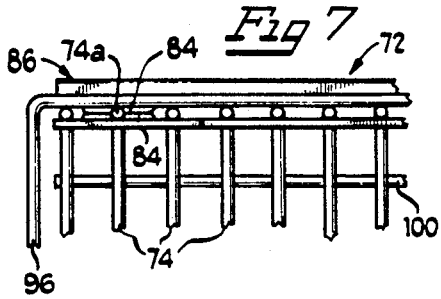
FIG. 7 is a fragmentary, cross-sectional, plan view taken along the line 7—7 of FIG. 6.
Figure 8:
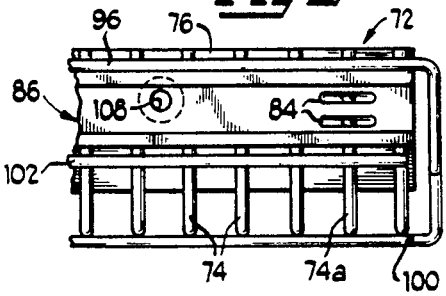
FIG. 8 is a fragmentary, rear elevational view of the shelf of FIG. 6.

With additional reference to FIGS. 6–8, the shelf member 72 preferably has a tray-like configuration being formed principally from a plurality of wire members 74. A rear plate 76 is secured to upstanding portions of wire members 74 by depressions 84 which straddle individual wires 74 (see FIGS. 6–8 and 10). The depressions 84 of the rear plate are spot-welded to corresponding depressions 84 of slide mounting member or channel 86. Referring to FIGS. 6 and 8, the rear plate 76 is illustrated as overlying a plurality of vertical wire portions. The depressions 84 are elongated in a horizontal direction and straddle an individual wire member 74*a*. A slide mounting member or channel generally indicated at 86 overlies the same wire member 74, but is located on the rear side of the shelf overlying the plate 76.

As can be seen in FIG. 8, recesses 84 are also formed in plate 76, the recesses being elongated in a horizontal direction and straddling the wire member 74*a*. The recessed portions 84 of the members 76, 86 extend toward one another and meet along a line passing through the wire member 74*a*, as illustrated in FIG. 7. Thus, both the plate 76 and channel 86 are readily secured to tray 72.

Referring to FIG. 9, the wire members 74 preferably have an S-shape with forward, downwardly-extending portions 88 which are joined together by an edge channel 90 which has a central, longitudinal depression 92 spot-welded to front wire portions 88. The depression 92 is similar to the depressions 84 except that the depression 92 is continuous throughout the length of channel 90, so as to accommodate spot-welding to front portion 88 of each wire member 74 of the shelf. Advertising indicia, prices or the like can conveniently be installed in channel 90 and can complement the placard installed in holder 52. The depression 92 has been omitted in the perspective views of FIGS. 1 and 2 for clarity of illustration.

Referring additionally to FIG. 10, shelf 72 preferably includes an outer encircling wire loop 96 which includes an upper rear portion extending above channel 86. As illustrated in FIG. 2, for example, the front and rear members are spot-welded to only a few wire members 74. However, each of the wire members 74 of a shelf are welded to the upper portion of the wire loop 96, and thus the rearward free ends of wire members 74 are secured together. Each shelf 72, the deeper of the two types of shelves illustrated herein, has three underlying cross-wires 100 which secure intermediate portions of wire members 74 together. In addition, a wire 102 is located below the channel 86 and is preferably spot-welded to each of the wire members 74, providing additional rigidity for the shelf construction. The wire loop 96 has a forward portion which passes underneath the wire members 74 and is secured thereto by spot-welding, thereby functioning, in part, as an additional wire 100. However, due to the loop construction, wire loop 96 provides a resilient support for the shelf, which resists twisting at the corners of the shelf and other distorting forces.

As illustrated in FIG. 10, for example, the crossbars 38 are telescopically received in channel 86. The shelves are inserted on a desired crossbar 38 by telescopically inserting the channel 86 of a shelf over a free end of a crossbar 38, and increasing the amount of telescopic insertion to a desired extent so as to provide the various configurations illustrated in FIG. 11. For example, with reference to FIG. 1, two shelves 72 may be telescopically inserted on the same crossbar 38 to provide the arrangement illustrated in FIG. 2 where outer portions of each shelf are cantilevered or overhang the support members to which they are connected.

In the preferred embodiment, the crossbars of the various base, frame and extension members are of similar cross-sectional dimension; and the channels of the various shelves are also of a similar, complementary cross-sectional dimension so that a particular shelf can be fitted to any of the crossbars 38, as desired. It should be noted in this regard that, in the preferred construction the small (less deep) shelf 70 has a construction similar to that of the shelf 72 described above, except that only a single underlying wire 100 is provided, as illustrated in FIG. 9. As can be seen in comparing FIGS. 9 and 10, the shelves 70, 72 are similar in shape and dimension, except for the depth of the shelves, the shelves 70 being of considerably lesser depth.

According to one aspect of the present invention, different configurations of shelving apparatus may be readily realized by the present invention. As mentioned, two shelves can be mounted on the same crossbar 38. However, as illustrated at the top of FIG. 2, a single shelf can also be mounted to a crossbar. The number of shelves on a particular crossbar can be varied from one crossbar to another, and multiple extension members 44 can be added as desired, to achieve any of the various configurations illustrated in FIG. 11*a*–11*n*. For example, in FIG. 11*a*, a single shelf is installed on each crossbar 38 of the frame member 30, and a single shelf is mounted on a single extension member. In FIG. 11*b*, the single shelf is mounted on each crossbar of a frame member, and extension members are omitted. The arrangement of FIG. 11*f* is similar to that of FIG. 11*b*, except that two shelves are installed side-by-side on the lower crossbar of the frame member.

In order to discourage unwanted rearrangement of a shelving apparatus, the shelves are fixed in place with releasable, resilient fasteners 104. The resilient fasteners are made of a material such as plastic or the like, and resemble ring-shank nails in construction, having a series of resilient rings disposed throughout the length of their shank. As illustrated in FIG. 9, the fasteners 104 are inserted through registered apertures of a shelf and mounting bar to prevent telescopic displacement of the shelf. A larger aperture 106 is formed in the rear plate 76, and is centered with respect to an aperture 108 formed in channel 86. As can be seen in FIG. 9, there is considerable distance between the members 76, 86, due to the interposition of wire members 74 between the two members. This provides a pocket or recess for receiving and partly enclosing the enlarged head of fastener 104, thereby conveniently preventing extraction of the fastener from the front of the shelving apparatus.

Each crossbar 38 is provided with a pair of apertures 110. Each shelf is also provided with a pair of apertures. According to one principle of the present invention, the apertures of the shelves and crossbars may be aligned in registry for two different configuration modes. In a first configuration mode, where two shelves are mounted on a single crossbar, a single aperture of a shelf is aligned with a single aperture of the crossbar, with the outboard or outlying apertures of the shelves being left open, as illustrated at the bottom of FIG. 2, for example. However, the spacings of the apertures on the mounting bars and shelves are such that one of the two shelves could be removed and the remaining shelf slid into position such that both apertures of a shelf are aligned in registry with both apertures of a mounting bar, an example of this configuration being shown at the top of FIG. 2.

After the number of shelves are located in place on the crossbars, the resilient fasteners 104 are pushed through the registered apertures until the enlarged head of the fastener is received within the recess between rear plate 76 and channel 86. If removal of the fastener is desired, a suitable instrument can be used to push the pointed free end of the fastener in a reverse direction, so as to bring the enlarged head out of the recess where it can be grasped at the plate 76.

According to one aspect of the present invention, the shelves are mounted only by telescopic insertion over the crossbar 38 with the resulting mounting providing the necessary, rigid cantilevered support for the shelves, even for the deeper shelves 72. The crossbar 38 has a cross-section which if elongated in a generally vertical direction and which is received in a complementary shaped channel in member 86.

With the preferred mounting of the shelves to the various structural members 30, 44, the shelves are retained in desired position. Preferably, the cross-sections of the interfitting crossbars and channels are uniform throughout their length, to provide a maximum contact between the two interfitting members. However, their cross-sections need not be continuous. For example, the crossbars and channels could be notched to form an alternating series of teeth and notches on each member so that the channels are first partly overlaid on the crossbars, with teeth of the channels registered with notches on the crossbar. The channels are then pressed against the crossbar and slid along their longitudinal axes to fully mate the channels and crossbars. If desired, other mounting arrangements could be employed. For example, the crossbars 38 could be attached to the shelves by an intermediate stand-off such as the above-mentioned wire 40. The channel members could then be provided on the various structural supports 30, 44, and such is contemplated by the present invention.

As can be seen, the shelving apparatus 10 can be completely assembled in relatively short time by merely inserting the various components within one another, with simple telescopic joining of one member to another being used throughout the shelving apparatus construction. Further, the shelving apparatus can be temporarily erected for evaluation purposes. For example, the shelves can be temporarily installed in any of the positions illustrated in FIG. 11, until a desired configuration is observed. At that point, the resilient fasteners 104 can be installed and any unnecessary extension can be removed to provide a final assembly.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following Claims.

What is claimed is:

1. Shelving apparatus, comprising:

a base member including a pair of upright base supports;

an upright frame member including at least two spaced apart, generally upright frame supports telescopically mated with said base supports and at least two spaced apart generally horizontal slide supports between said frame supports having a preselected length and a cross-section throughout said length;

a plurality of shelves cantilevered from said slide supports, said shelves including a rear portion with a slide mounting member having a length and a preselected cross-section throughout said length complementing the cross-section of said slide supports and said slide mounting member extending in a lengthwise direction between said frame supports;

said slide supports and said slide mounting members telescopically engaged with one another; and at least one fastener means extending through each telescopically engaged slide support and slide mounting member to prevent disengagement thereof.

2. The apparatus of claim 1 wherein at least two shelves are cantilevered from the same slide support.

3. The apparatus of claim 1 wherein said slide supports are telescopically received within said slide mounting member, and wherein each slide mounting member and each slide support includes at least two apertures for receiving said fastener means, the apertures of said slide mounting member and said slide support being positioned for two modes of operation, with a first mode of operation wherein both apertures of said slide mounting member are aligned in registry with the apertures of said slide support when a single shelf is mounted on a slide support and with a second mode of operation wherein, with two shelves mounted on the same slide support, one aperture of each said slide mounting member is aligned in registry with a respective aperture of said slide support.

4. The apparatus of claim 1 wherein said frame supports have respective central axes, said slide supports and said slide mounting members have elongated cross-sections with respective longitudinal axes, and said slide supports are secured to said frame supports so that the longitudinal axis of said slide support cross-section forms a preselected angle with the central axes of the frame supports to which the slide support is joined.

5. The apparatus of claim 4 wherein said base supports are raked in a backward direction and said frame supports have longitudinal centerlines aligned along the means for adjusting an amount of telescopic engagement of said base and said frame supports.

6. The apparatus of claim 1 wherein said shelves have forward free ends opposite the rear portions of the shelves, said frame supports extend along a common plane and said slide supports have elongated cross-sections inclined with respect to said common plane so as to raise the forward free ends of said shelves.

7. The apparatus of claim 6 wherein said slide mounting member comprises a flat bar and said slide support has a generally C-shaped cross-section defining a channel for receiving the flat bar.

8. The apparatus of claim 1 wherein said fastener means includes a head portion and said slide mounting member includes a pair of spaced plates defining a recess therebetween for receiving said head portion and for partly enclosing said head portion to prevent dislodgement from said recess.

9. Shelving apparatus, comprising:

a base member including a pair of upright base supports;

an upright frame member including at least two spaced apart, generally upright frame supports telescopically a plurality of shelves cantilevered from said slide supports, said shelves including a rear portion with a slide mounting member having a length and a generally uniform cross-section throughout said length and extending in a lengthwise direction between said frame supports;

said slide supports and said slide mounting members telescopically engaged with one another;

at least one fastener means including a head portion and extending through each telescopically engaged slide support and slide mounting member to prevent disengagement thereof;

said slide mounting member includes a pair of spaced plates defining a recess therebetween for receiving and partly enclosing said head portion and for shielding said head portion to prevent dislodgement from said recess; and said slide supports and said slide mounting members have elongated cross-sections with respective longitudinal axes, said slide supports secured to said frame supports so that the longitudinal axis of said slide support cross-section forms a preselected angle with the central axes of the frame supports to which the slide support is joined.

* * * * *

UNITED STATES PATENT AND TRADEMARK OFFICE

CERTIFICATE OF CORRECTION

PATENT NO. : 5,272,991

DATED : December 28, 1993

INVENTOR(S) : Carrigan, et al.

It is certified that error appears in the above-indentified patent and that said Letters Patent is hereby corrected as shown below:

Claim 5, Column 8, line 15, after "along the" insert --longitudinal centerlines of said base supports, said base supports and said frame supports having cooperating adjustment--.

Claim 9, Column 8, line 38, after "telescopically" insert --mated with said base supports and at least two spaced apart generally horizontal slide supports between said frame supports having a preselected length and a generally uniform cross-section throughout said length, and said frame supports have respective central axes;--.

Signed and Sealed this

Thirty-first Day of May, 1994

Bruce Lehman

*Attest:*

BRUCE LEHMAN

*Attesting Officer*

*Commissioner of Patents and Trademarks*